US011629034B2

(12) United States Patent
Heidrich et al.

(10) Patent No.: US 11,629,034 B2
(45) Date of Patent: Apr. 18, 2023

(54) CRANE TELESCOPE LOCKING DEVICE

(71) Applicant: Manitowoc Crane Group France SAS, Dardilly (FR)

(72) Inventors: Thomas Heidrich, Dresden (DE); Hasko Karge, Wilhelmshaven (DE); Johannes Schuermann, Jever (DE)

(73) Assignee: MANITOWOC CRANE GROUP FRANCE SAS, Dardilly (FR)

( * ) Notice: Subject to any disclaimer, the term of this patent is extended or adjusted under 35 U.S.C. 154(b) by 735 days.

(21) Appl. No.: 16/517,062

(22) Filed: Jul. 19, 2019

(65) Prior Publication Data

US 2020/0024111 A1 Jan. 23, 2020

(30) Foreign Application Priority Data

Jul. 20, 2018 (DE) ..... 102018117630.9

(51) Int. Cl.
*B66C 23/70* (2006.01)
*F15B 15/16* (2006.01)
*F15B 15/26* (2006.01)

(52) U.S. Cl.
CPC ..... *B66C 23/708* (2013.01); *F15B 15/16* (2013.01); *F15B 15/261* (2013.01); *F15B 2211/7057* (2013.01); *F15B 2211/72* (2013.01)

(58) Field of Classification Search
CPC ..... B66C 23/705; B66C 23/708; F15B 15/16; F15B 15/261; F15B 2211/7057; F15B 2211/72
See application file for complete search history.

(56) References Cited

U.S. PATENT DOCUMENTS 4,327,533 A * 5/1982 Sterner ..... B66C 23/708 212/292
10,604,386 B2 * 3/2020 Kawabuchi ..... B66C 23/705
2010/0187194 A1 * 7/2010 Schuermann ..... B66C 23/708 212/292
2014/0001140 A1 * 1/2014 Wimmer ..... B66C 23/42 212/299

(Continued)

FOREIGN PATENT DOCUMENTS

CN 104591012 A * 5/2015 ..... B66C 23/705
CN 104773653 B 3/2017

(Continued)

OTHER PUBLICATIONS

Extended European Search Report issued by EPO in connection with EP19181090 dated Dec. 11, 2019.

(Continued)

*Primary Examiner* — Kenneth Bomberg
*Assistant Examiner* — Matthew Wiblin
(74) *Attorney, Agent, or Firm* — Cook Alex Ltd.

(57) ABSTRACT

A crane telescope locking device includes a control device which is hydraulically in contact with a telescoping cylinder of a crane telescope and, for the purpose of actuating, with at least one cylinder lock hydraulic cylinder and includes a valve which is open in its inactivated resting state and thus opens a fluidic connection between the telescoping cylinder and the at least one cylinder lock hydraulic cylinder. A telescoping cylinder (6) of a crane includes such a crane telescope locking device.

7 Claims, 1 Drawing Sheet

(56) References Cited

U.S. PATENT DOCUMENTS

| | | | | |
|---|---|---|---|---|
| 2015/0060385 | A1* | 3/2015 | Matsuda | B66C 23/708 212/349 |
| 2015/0144583 | A1* | 5/2015 | Matsumoto | B66C 23/705 212/276 |
| 2016/0244306 | A1* | 8/2016 | Kawabuchi | B66C 23/22 |

FOREIGN PATENT DOCUMENTS

| | | | |
|---|---|---|---|
| DE | 202018102111 | U1 | 4/2018 |
| EP | 2210853 | A2 | 7/2010 |
| EP | 3138805 | A1 | 3/2017 |

OTHER PUBLICATIONS

German Office Action dated Mar. 13, 2019 in connection with corresponding German Patent Application DE 10 2018 117 630.9.

* cited by examiner

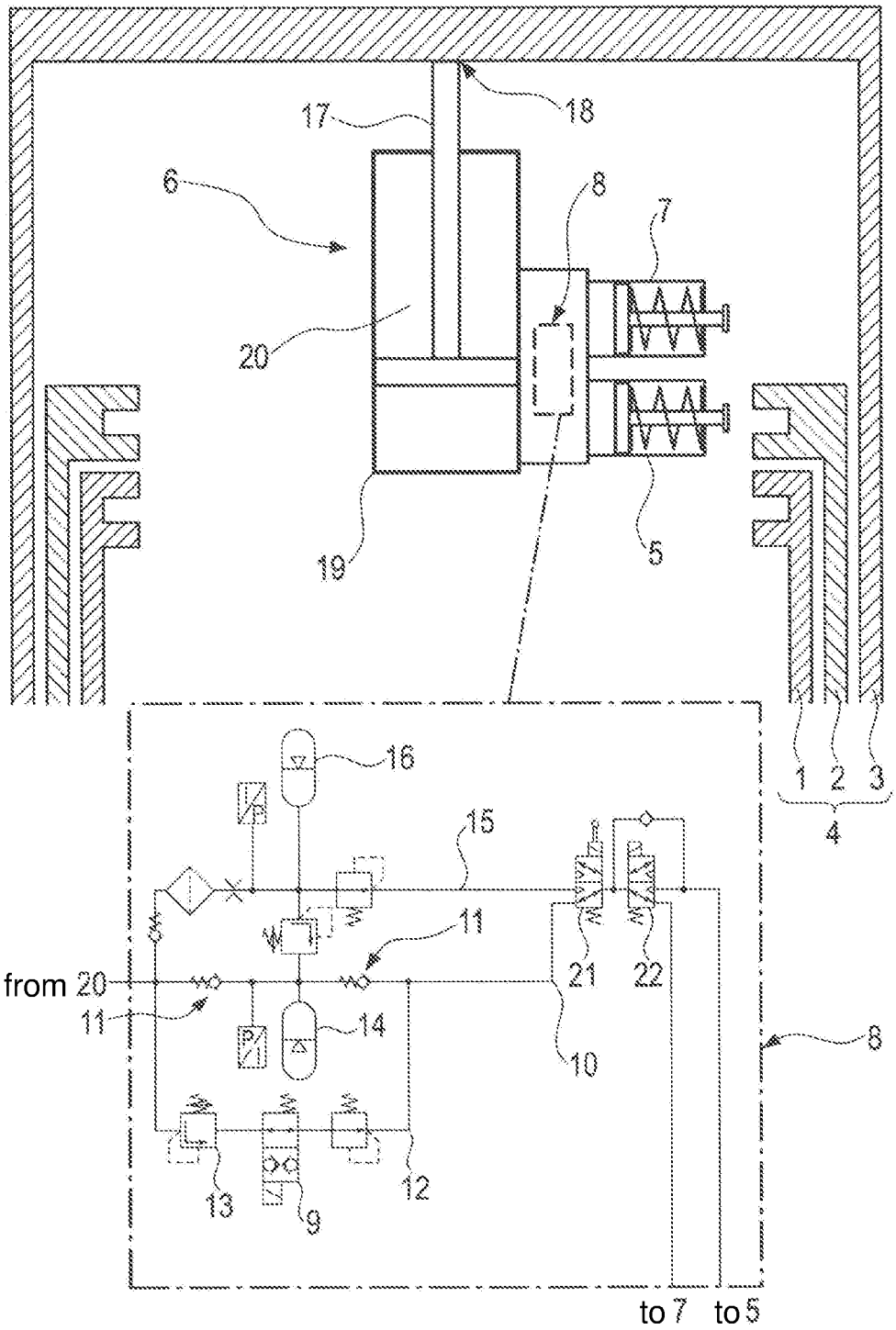
17
18
6
8
7
20
19
5
1
2
3
4
16
15
11
from 20
11
21
22
14
10
8
13
9
12
to 7
to 5

CRANE TELESCOPE LOCKING DEVICE

The present invention relates to a locking device for a crane telescope, for example a telescopic jib or a telescopic tower of a mobile crane, by means of which the individual telescopic sections can be releasably locked to each other and, for the purpose of telescoping, to a telescoping cylinder of the crane telescope. Such locking devices are also referred to as a locking head if they are arranged in their entirety at the movable end of the telescoping cylinder.

The locking mechanisms of known telescoping systems, such as are described for example in EP 0 943 580 B1, are hydraulically supplied with the hydraulic fluid, necessary to activate it, via an inner passage through the telescoping cylinder. More recent solutions at least partially omit the supply by means of such a passage and instead retrieve the necessary hydraulic fluid from a cylinder space in the telescoping cylinder. In such solutions, however, the valves necessary for this purpose and other control units of the locking mechanism are no longer accessible in most operational positions, once installed. This means that in the event of disruption, such as a failure of the control electronics or other electrical components of the locking mechanism, it is no longer possible to activate the cylinder lock. If the crane telescope, such as the telescopic jib, is also in an unfavourable position, then recovery will entail significant effort.

It is the object of the present invention to remedy this problem and to enable the cylinder lock to be released even when the control electronics fail.

This object is solved by embodiments of the present invention.

The crane telescope locking device in accordance with the present invention comprises:

- at least one cylinder lock hydraulic cylinder which is embodied to releasably couple a telescoping cylinder and a telescopic section to each other; and
- a control device which is hydraulically in contact with a telescoping cylinder of the crane telescope and with the at least one cylinder lock hydraulic cylinder, wherein the control device comprises a valve which is open in an inactivated resting state and thus opens a fluidic connection between the telescoping cylinder and the at least one cylinder lock hydraulic cylinder.

In other words, the locking device in accordance with the invention which can for example be used in a telescopic jib or a telescopic tower of a mobile crane comprises at least one and in particular two hydraulic cylinders which is/are assigned to a cylinder lock. In addition to the cylinder lock, the locking device in accordance with the invention can also comprise a telescopic section lock which co-operates for example with the cylinder lock, i.e. is actuated together with the cylinder lock, or else acts separately from the cylinder lock and is also separately actuated. A telescopic section lock can likewise comprise at least one and in particular two hydraulic cylinders in order to activate the lock between two telescopic sections of the crane telescope. The control device can accordingly also be responsible for supplying the at least one telescopic section lock hydraulic cylinder and can be hydraulically in contact with both the telescoping cylinder of the crane telescope and the at least one telescopic section lock hydraulic cylinder for this purpose. While individual telescopic sections can be locked to each other in an axial position with respect to each other and also unlocked from each other again by means of the telescopic section lock, it is the function of a cylinder lock to lock the telescoping cylinder of the crane telescope to the respective telescopic section and also unlock it again for the purpose of extending the individual telescopic sections and also retracting them again. In order to activate these hydraulic cylinders, the locking device comprises a hydraulic control device which retrieves the hydraulic fluid, necessary for activating, from a cylinder space in the telescoping cylinder, feeds it to the hydraulic cylinders in a desired way, and also feeds it back from the hydraulic cylinders into the telescoping cylinder.

In order to overcome the problems mentioned above, the control device comprises a valve which when activated, i.e. including when the control electronics or actuator are intact, closes a hydraulic connection between the retrieval point on the telescoping cylinder and the hydraulic cylinder(s) of the cylinder lock. When the control electronics or actuator are broken, this valve automatically reverts to its non-activated base position, so to speak, and thus opens said connection. Since the hydraulic cylinder(s) of the cylinder lock is/are then connected to a cylinder space in the telescoping cylinder, the cylinder lock can be released and/or unlocked by pressurising the hydraulic cylinder(s) of the cylinder lock together with the corresponding cylinder space in the telescoping cylinder.

The invention accordingly provides an emergency operating mode for the cylinder lock which is initiated fully automatically, so to speak, by the control electronics or actuator failing and the valve consequently reverting to its open resting position.

In one embodiment of the present invention, the control device comprises a return line via which hydraulic fluid can be fed back from the telescopic section lock hydraulic cylinders and/or the cylinder lock hydraulic cylinders into the cylinder space in the telescoping cylinder, wherein the valve opens the return line in a direction opposite to the feedback.

In other words, the return line which is embodied to feed the hydraulic fluid back into the telescoping cylinder is used, in the emergency operating mode, to move hydraulic fluid in the opposite direction from the telescoping cylinder into the hydraulic cylinder of the cylinder lock, in order to ultimately release the cylinder lock. This is however only possible once the valve is in its open resting position.

In a more specific embodiment, the return line comprises at least one closing valve and a bypass which bypasses the at least one closing valve and which is opened by the valve which is opened in its inactivated resting state.

While it is the function of the at least one closing valve to enable the hydraulic fluid to be fed from the hydraulic cylinders of the cylinder lock or telescopic section lock back into the telescoping cylinder, but to prevent a backflow of the hydraulic fluid, the bypass overrides the at least one closing valve, so to speak, as soon as it is opened by the valve reverting to its resting state, and enables the hydraulic fluid to flow from the telescoping cylinder to the hydraulic cylinder of the cylinder lock via the return line.

The return line, in particular the bypass, can also comprise—in addition to the valve—an additional pressure sequence valve which only opens the return line in the opposite direction and/or opens the bypass above a defined pressure.

This means that the process of unlocking the cylinder lock is only triggered when a particular pressure in the telescoping cylinder is exceeded. In the event of damage, the cylinder lock can thus be activated by a high pressure in the telescoping cylinder. At a lower pressure in the telescoping cylinder, the latter can perform its actual function of telescoping. The locking device can thus be moved to a position which is favourable for inspection or repair.

In another embodiment, the return line comprises a pressure reservoir, in particular a low-pressure reservoir, which receives the hydraulic fluid from the telescopic section lock hydraulic cylinder and/or the cylinder lock hydraulic cylinder before it is fed back into the telescoping cylinder.

This pressure reservoir thus serves as an intermediate reservoir for the hydraulic fluid to be fed back, which in particular operating states of the telescoping cylinder and the associated pressure conditions can be fed back into the telescoping cylinder only later.

The control device can also comprise a feed line, in particular one which is separated from the return line, via which the hydraulic fluid is fed from the telescoping cylinder to the telescopic section lock hydraulic cylinder and/or cylinder lock hydraulic cylinder. During normal operation, the hydraulic cylinders of the locking device are thus supplied exclusively via the feed line, while the return line serves exclusively to feed the hydraulic fluid back towards the telescoping cylinder.

The feed line can then specifically comprise a pressure reservoir, in particular a high-pressure reservoir, which receives the hydraulic fluid from the telescoping cylinder before it is fed to the telescopic section lock hydraulic cylinder and/or cylinder lock hydraulic cylinder, wherein the high-pressure reservoir is filled with hydraulic fluid, as soon as high pressure prevails in the telescoping cylinder, and can discharge this pressurised hydraulic fluid to the hydraulic cylinder(s) of the cylinder lock or telescopic section lock in order to activate it.

While the solution in accordance with the invention as described above can be used in any crane telescopes which are activated by means of telescoping cylinders, it is in particular designed to be used in a telescopic jib or telescopic tower of a crane and in particular in mobile cranes.

Another aspect of the present invention relates to a telescoping cylinder of a crane, in particular for telescoping a jib or tower, comprising: a first cylinder part which comprises a fastening portion embodied to fasten the telescoping cylinder to a base of a crane telescope; and a second cylinder part which can be moved relative to the first cylinder part and which comprises a crane telescope locking device in one of the embodiments described above.

The locking device in accordance with the invention can thus be moved together with the moving cylinder part of the telescoping cylinder within the crane telescope, in particular to an inspection or repair position.

The control device can also be in fluidic contact with the piston-rod-end annular space of the telescoping cylinder. If it is the piston rod of the telescoping cylinder which is connected stationarily to the base section of the crane telescope, the piston-rod-end annular space of the telescoping cylinder is pressurised when the cylinder lock is unlocked in the emergency operating mode, such that once it is unlocked, the telescoping cylinder is moved into an inspection or repair position.

In the following, a preferred embodiment of the present invention is explained in more detail with the aid of the enclosed FIGURE. It can comprise any of the features described here, individually and in any expedient combination.

FIG. 1 schematically shows a preferred embodiment of the crane telescope locking device in accordance with the invention, which comprises the hydraulic cylinder 5 which is designed to activate a lock (not shown) between the telescopic sections 1, 2 and 3 of the telescope 4. In addition, the locking device also comprises a hydraulic cylinder 7 which can be indirectly coupled to one of the telescopic sections 1, 2 via engagements. The corresponding telescopic section 1, 2 is thus in turn fixedly coupled to the extending and retracting part 19 of the telescoping cylinder 6 and can be telescoped in and/or out together with the part 19 relative to the base section 3. When telescoping in and out, the moving part 19 of the telescoping cylinder 6 is moved relative to the piston rod 17 which is fixedly connected to the base section 3 via the interface 18. It should be noted at this juncture that the arrangement of the telescopic sections 1, 2 and 3 and hydraulic cylinders 5 and 7 is shown purely schematically and that the engagements necessary for the ultimate coupling processes can comprise an additional mechanism (not shown) between the hydraulic cylinders 5 and 7 on the one hand and the telescopic sections 1, 2 and 3 on the other.

The control device 8 designed to activate the hydraulic cylinders 5 and 7 is hydraulically connected both to the hydraulic cylinders 5 and 7 and to the piston-rod-end annular space 20 of the telescoping cylinder 6 and retrieves the hydraulic fluid necessary for activating the hydraulic cylinders 5 and 7 from the annular space 20 and also feeds it back there again.

Given a sufficiently high pressure in the annular space 20, hydraulic fluid is moved into the high-pressure reservoir 16 via the feed line 15, while the return line 10 together with the bypass 12 is closed to the hydraulic fluid coming from the annular space 20 by means of the closing valves 11 and the valve 9 which is always closed during normal operation.

In order to activate the hydraulic cylinders 5 and 7, the hydraulic fluid is retrieved from the high-pressure reservoir 16 and channelled in a desired way to the cylinder space of the hydraulic cylinder 5 and/or 7 via the two correspondingly switched two-way valves 21 and 22. It should be noted at this juncture that the two-way valves 21 and 22 connect the cylinder space of the hydraulic cylinder 7 to the return line 10 in the inactivated resting state, i.e. including when the control electronics or actuator have failed or are broken.

As soon as hydraulic fluid is to be discharged from the cylinder spaces of the hydraulic cylinders 5 or 7, it is channelled into the return line 10 via the correspondingly switched two-way valves 21 and 22 and into the annular space 20 via the closing valves 11 which open in this direction, wherein the bypass 12 is in turn closed by the valve 9. The same applies to the feed line 15 which comprises a closing valve (not indicated) which closes in the direction of the annular space 20.

If the control electronics or actuator for the control device 8 and its valves 9, 21, 22 fail, said valves assume their inactivated resting position, wherein the valves 21 and 22 connect the cylinder space of the hydraulic cylinder 7 to the return line 10, and the valve 9 opens the bypass 12. If, at the time of the damage, the moving cylinder part 19 is coupled to one of the telescopic sections 1 and 2 via the hydraulic cylinder 7 and is also in a position in which access to the control device 8 situated on the moving cylinder part 19 is not possible, the cylinder space of the hydraulic cylinder 7 can be pressurised and the cylinder lock released by pressurising the annular space 20 which is hydraulically connected to the hydraulic cylinder 7 when the valves 9, 21 and 22 are in the "emergency operating mode" position shown in FIG. 1. The valves 21 and 22 close the hydraulic fluid's path from the annular space 20 to the hydraulic cylinder 7 via the feed line 15. The same applies to the strand of the return line 10 which is closed by means of the closing valves 11. The bypass 12, by contrast, is opened by the valve 9 which is in its resting position. In order to activate the hydraulic cylinder 7, it is merely necessary to apply a sufficiently high pressure, such that the pressure sequence valve 13 opens. At a lower pressure, the bypass 12 is also closed by the pressure sequence valve 13. In this case, only the telescoping cylinder 6 is retracted, whereas the hydraulic cylinder 7 of the cylinder lock is not activated.

In the scenario shown, the cylinder lock and thus the coupling between the moving cylinder part 19 of the telescoping cylinder 6 and one of the telescopic sections 1, 2 is released by pressurising the annular space 20, whereupon the telescoping cylinder 6 is retracted to an inspection or repair position.

The invention claimed is:

1. A crane telescope locking device for a crane telescope having a telescoping cylinder and telescopic sections, the locking device comprising:

at least one first hydraulic cylinder configured to releasably couple the telescoping cylinder and a telescopic section of the telescopic sections to each other; and a control device in hydraulic contact with the telescoping cylinder and the at least one first hydraulic cylinder, wherein the control device is configured to actuate the at least one first hydraulic cylinder by controlling hydraulic fluid flow from the telescoping cylinder to the at least one first hydraulic cylinder, wherein the control device comprises a valve which is open in an inactivated resting state to fluidically connect the telescoping cylinder to the at least one first hydraulic cylinder, wherein the control device comprises a return line comprising at least one closing valve and a bypass which bypasses the at least one closing valve, the bypass comprising the valve, and wherein hydraulic fluid is fed in the direction from the telescoping cylinder toward the at least one first hydraulic cylinder via the bypass when the at least one closing valve is closed and the valve is open in the inactivated resting state.

2. The crane telescope locking device according to claim 1, wherein the bypass additionally comprises a pressure sequence valve configured to open the return line for hydraulic fluid flow in the direction from the telescoping cylinder toward the at least one first hydraulic cylinder and/or open the bypass above a defined pressure.

3. The crane telescope locking device according to claim 1, wherein the return line comprises a pressure reservoir configured to receive the hydraulic fluid from the at least one first hydraulic cylinder before the hydraulic fluid is fed back into the telescoping cylinder.

4. The crane telescope locking device according to claim 1, wherein the control device comprises a feed line via which the hydraulic fluid is fed from the telescoping cylinder to the at least one first hydraulic cylinder.

5. The crane telescope locking device according to claim 4, wherein the feed line comprises a pressure reservoir configured to receive the hydraulic fluid from the telescoping cylinder before the hydraulic fluid is fed to the at least one first hydraulic cylinder.

6. The crane telescope locking device according to claim 1, further comprising at least one second hydraulic cylinder configured to operate a section lock to releasably couple the telescopic sections to each other.

7. A telescoping cylinder of a crane, comprising:

a first cylinder part comprising a fastening portion configured to fasten the telescoping cylinder to a base of a crane telescope;

a second cylinder part configured for movement relative to the first cylinder part, the second cylinder part comprising a crane telescope locking device; and an annular space between the first cylinder part and the second cylinder part, wherein the crane telescope locking device comprises:

at least one cylinder lock first hydraulic cylinder configured to releasably couple the second cylinder part and a telescopic section of the crane telescope to each other; and a control device in hydraulic contact with the annular space and the at least one first hydraulic cylinder, wherein the control device is configured to actuate the at least one first hydraulic cylinder by controlling hydraulic fluid flow from the annular space to the at least one first hydraulic cylinder, wherein the control device comprises a valve which is open in an inactivated resting state to fluidically connect the and annular space to the at least one first hydraulic cylinder, wherein the control device comprises a return line comprising at least one closing valve and a bypass which bypasses the at least one closing valve, the bypass comprising the valve, and wherein hydraulic fluid is fed in the direction from the annular space toward the at least one first hydraulic cylinder via the bypass when the at least one closing valve is closed and the valve is open in the inactivated resting state.

* * * * *